US005720419A

United States Patent [19]

Li

[11] Patent Number: 5,720,419

[45] Date of Patent: Feb. 24, 1998

[54] PRE-COMPRESSION PUMP SPRAYER HAVING IMPROVED INLET AND DISCHARGE VALVING AND AN IMPROVED PUMP PRIMING FEATURE

[75] Inventor: Tanny Li, Walnut, Calif.

[73] Assignee: Calmar Inc., City of Industry, Calif.

[21] Appl. No.: 613,658

[22] Filed: Mar. 11, 1996

[51] Int. Cl.[6] ..... B65D 88/54

[52] U.S. Cl. ..... 222/321.2; 222/321.9

[58] Field of Search ..... 222/321.2, 321.9

[56] References Cited

U.S. PATENT DOCUMENTS

| | | | |
|---|---|---|---|
| Re. 33,235 | 6/1990 | Corsette . | |
| 2,002,783 | 5/1935 | Long . | |
| 2,025,296 | 12/1935 | McIntyre . | |
| 4,051,983 | 10/1977 | Anderson . | |
| 4,524,888 | 6/1985 | Tada . | |
| 5,064,105 | 11/1991 | Montaner . | |
| 5,358,149 | 10/1994 | O'Neill . | |
| 5,522,547 | 6/1996 | Dobbs et al. | 239/333 |
| 5,626,264 | 5/1997 | Florez et al. | 222/321.2 |
| 5,649,649 | 7/1997 | Marelli | 222/321.2 |

*Primary Examiner*—Gregory L. Huson

*Attorney, Agent, or Firm*—Watson Cole Stevens Davis, P.L.L.C.

[57] ABSTRACT

A pre-compression pump sprayer has a spring biased discharge poppet valve element with a seal in engagement with the wall of the piston stem, a seal interruption to establish a discharge valve open position, and an upstream directed throttle valve presenting a two-stage pressure build-up discharge valve establishing a predetermined pressure threshold which when exceeded by fluid pressure generated in the pump chamber during pumping immediately opens the throttle valve and abruptly releases the fluid pressure at the valve open position. The valve has an elongated probe extending into the pump chamber of an extent as to shift the poppet valve open upon engaging the inlet check valve upon a full downstroke of the piston for evacuating air from the pump chamber out through the discharge orifice to effect pump priming. During pumping operation, product is sucked back from around the discharge orifice into the discharge passage at the commencement of the piston suction stroke as the discharge valve remains momentarily open. An inlet check valve has a center of gravity located upstream of its valve seat to assure accurate seating of the inlet valve during pump operation at angles tilted from upright. And, a dry piston return spring is optionally provided, as is a diametral container vent seal.

15 Claims, 3 Drawing Sheets

PRE-COMPRESSION PUMP SPRAYER HAVING IMPROVED INLET AND DISCHARGE VALVING AND AN IMPROVED PUMP PRIMING FEATURE

BACKGROUND OF THE INVENTION

This invention relates generally to a pre-compression pump sprayer, and more particularly to such a sprayer having improved inlet and discharge valving and an improved pump priming feature.

Many pre-compression pump sprayers have a poppet for valving the discharge through a hollow piston which operates in a pump cylinder defining a variable volume pump chamber therewith. Upon a build-up of pressure in the chamber during pumping, the popper unseats when the hydraulic pump pressure exceeds the closing force of a popper closing spring. On each ensuing suction stroke of the piston, the negative pressure developed in the expanding pump chamber draws product into the chamber while the spring acting on the popper closes the discharge. The formation of dribbles and drips at the discharge orifice is substantially avoided by the abrupt closing of the discharge, which relies on the difference between the hydraulic pressure and the spring closing force acting on the popper.

The pump chamber of the pre-compression sprayer must be primed with product in as few strokes as possible to provide an efficiently operating and acceptable pump. Priming of unwanted air from the pump chamber prior to an initial pumping operation is effected in a variety of ways, such as by the provision of a rib or groove on the wall of the pump chamber as in U.S. Pat. No. 4,051,983 for breaking a seal on the popper permitting expulsion of air from the pump chamber in a downward direction into the container via the dip tube.

Another approach to pump priming is disclosed in U.S. Pat. No. 5,064,105 which provides a grooved protuberance on the wall of the pump chamber for breaking the piston seal permitting the venting of air from the pump chamber upwardly past the piston and into the container via a side opening in the pump cylinder.

U.S. Pat. No. 4,524,888 discloses a pump dispenser having a throttle-type discharge valve engageable with a downstream facing discharge valve seat, the discharge valve having an elongated valve spindle which, in a lock-down position of the dispenser head, presses the inlet valve against its valve seat and disengages the discharge from its seat to thereby prevent inflow of product into the pump chamber. Otherwise, in the lock-down position of the head, a discharge valve return spring maintains the throttle discharge valve seated.

Also, many pre-compression pump sprayers are provided with a caged inlet ball check valve which unseats during each suction stroke of the piston during the suctioning of liquid product into the chamber. The ball valve is seated tightly against its valve seat during each pressure stroke of the piston to avoid leakage from the pump chamber during the pressure strokes. However, since the center of gravity of the ball valve is located downstream of its valve seat, the ball valve tends to unseat under the force of gravity when operating the pump in attitudes tilted to one side or another from an upright position. If unseated, even momentarily, during pumping in this attitude, there is a tendency of product to blow-by the inlet valve, dumping some product under pressure into the container, thereby reducing product output from the chamber through the orifice during the pressure stroke.

SUMMARY OF THE INVENTION

It is an object of the present invention to provide a pre-compression pump sprayer having an improved pump priming feature effecting a reduced number of strokes-to-prime while reducing the number of parts required for the pump structure, thereby producing savings in part cost and assembly. The present pump also has a suck-back feature to avoid the formation of dribbles and drips at the discharge orifice, and has an improved inlet valve permitting effective pump operation at various tilt angles of the pump.

A further object is to provide a two-stage spring biased pressure build-up discharge valve element permitting a well defined and improved particle size and distribution range of fluid issuing from the discharge orifice as a fine mist spray, and capable of effecting an abrupt cutoff of discharge to avoid the formation of dribbles and drips from the discharge orifice. Such two-stage pressure build-up discharge valve element is similar to that disclosed in U.S. Pat. No. 5,522,547 commonly owned herewith.

According to the invention, the discharge valve seat in the hollow piston faces in a downstream direction, and the poppet discharge valve is biased into its seated position by a secondary spring located within the plunger head. The discharge valve has an elongated probe extending into the pump chamber a predetermined distance to shift the discharge valve open, for pump priming, upon impacting against the inlet valve when full stroking the piston. Unwanted air is thus evacuated from the pump chamber through the open discharge to the atmosphere via the discharge orifice, thus improving upon the strokes-to-prime for the pump.

After priming, the pump operates as in any standard pre-compression pump sprayer to open the discharge in response to a build-up of pressure in the chamber which overcomes the return force of the secondary spring to thereby open the discharge valve cleanly and abruptly, the discharge valve remaining momentarily open at the commencement of the ensuing upstroke of the piston such that the reduced atmospheric pressure in the chamber sucks back any residual liquid product at the discharge orifice into the discharge passage to avoid the formation of dribbles and drips at the orifice. The relative spring tension between the secondary spring and the primary piston return spring can be chosen to accommodate liquids of different viscosities and to assure the momentary opening of the discharge at the commencement of the piston suction stroke.

The discharge valve element has a seal in sliding sealing engagement with an inner wall of the piston stem, and means are provided cooperating between the seal and such inner wall to establish a discharge valve open position. The valve element has an upstream directed throttle valve established a predetermined pressure threshold which when exceeded by fluid pressure generated in the pump chamber upon piston reciprocation immediately opens the throttle valve and abruptly releases the fluid pressure at the valve open position.

The inlet check valve is structured as having its center of gravity located upstream of its valve seat. The inlet valve thus remains accurately seated during pump operation at various tilted attitudes of the pump by the operator.

According to another feature of the invention, a "dry" piston return spring is provided by locating the spring outside the pump chamber. And, the container vent seal is improved by providing a diametral shipper seal arrangement for sealing the container vent passage closed.

Other objects, advantages and novel features of the invention will become more apparent from the following detailed description of the invention when taken in conjunction with the accompanying drawings.

DETAILED DESCRIPTION OF THE INVENTION

Figure 1:
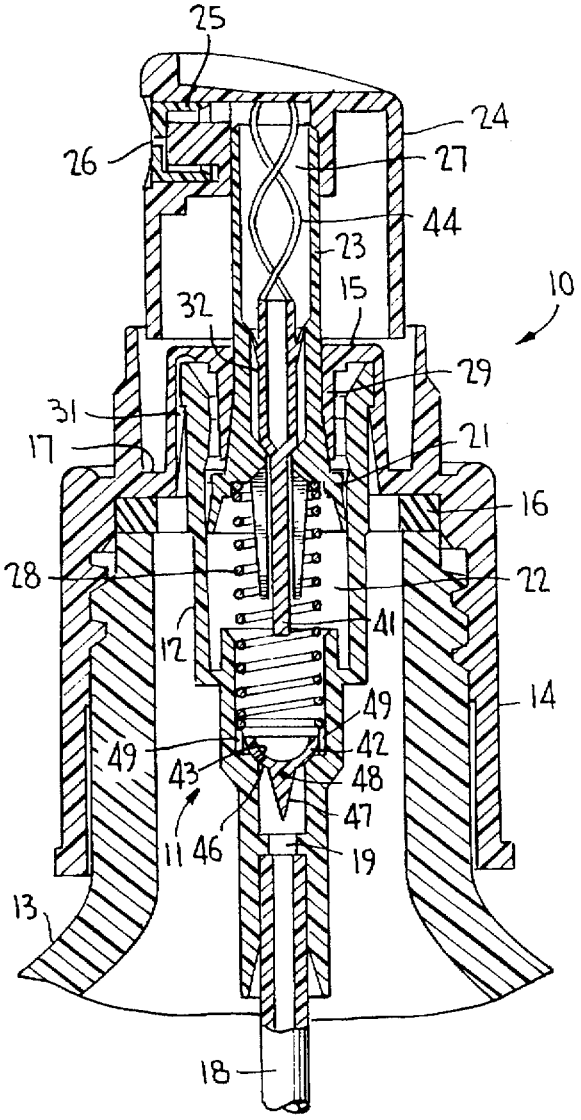
FIG. 1 is a vertical sectional view of the pre-compression pump sprayer incorporating the various features of the invention, shown in an at rest position of the piston.

Turning now to the drawings wherein like reference characters refer to like and corresponding parts throughout the several views, the pre-compression pump sprayer of the invention, generally designated 10 in FIG. 1 has a pump body 11 which includes a pump cylinder 12 mounted on a container 13 of liquid to be sprayed by the provision of a thread closure 14 having a central domed portion 15 coupled to cylinder 12 similarly as disclosed in U.S. Pat. No. 4,051,983, for mounting the pump sprayer to container 14. An elastomeric gasket seal 16 may be provided between flange 17 of the closure and the edge of the bottle neck for fluid tightly sealing the closure in place.

The pump cylinder supports a depending dip tube 18 extending from inlet port 19 into the container.

A pump piston 21 is mounted in sliding sealing engagement within the pump cylinder to therewith define a variable volume pump chamber 22. Hollow stem 23 of the piston projects through domed portion 15 and is coupled to a plunger head 24 having a nozzle cap 25 containing known spin mechanics and a spin chamber communicating with a discharge orifice 26 to effect the discharge of a fine mist spray. Discharge passage 27 is defined within the hollow stem and communicates with the discharge orifice via the spin mechanics and spin chamber.

The piston is urged into its FIG. 1 position by a primary piston return spring 28 which may extend between the underside of the piston and the bottom end of the pump chamber.

Conical surfaces acting between the lower outer surface of the piston stem and a sleeve 29 depending from domed portion 15 seals the container against leakage in the FIG. 1 position through a container vent passage 31 formed between the domed portion and the upper end of the pump cylinder, and between flange 29 and the piston stem, similarly as in U.S. Pat. No. 4,051,983. This passage forms a container vent passage for venting the interior of the container to atmosphere during pumping through an annular gap formed between the piston stem and sleeve 29 during each piston downstroke, as disclosed in the '983 patent.

Figure 2:
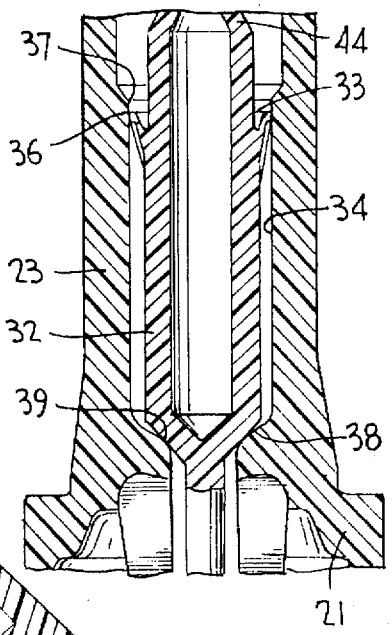
FIG. 2 is a view similar to FIG. 1 of an enlarged detail of the discharge valve element shown fully closed.
Figure 5:
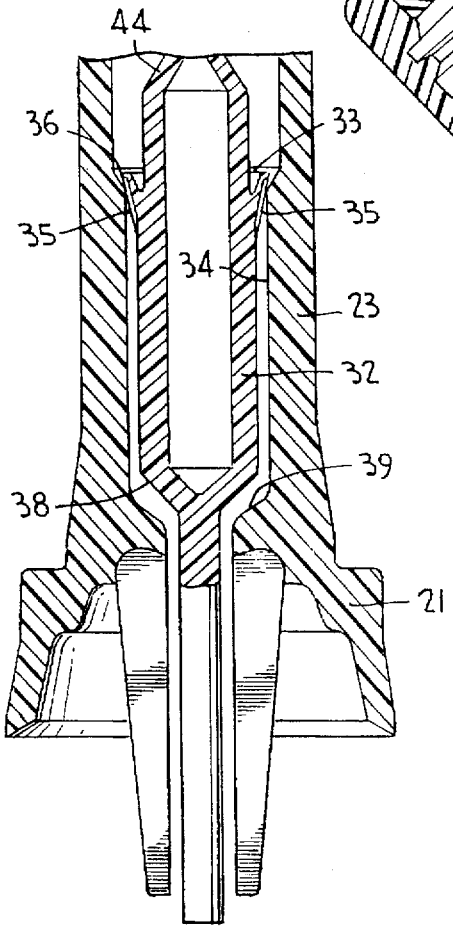
FIG. 5 is a view similar to FIG. 2 of an enlarged detail of the discharge valve element shown fully open.

A discharge poppet valve element 32, shown in detail in FIGS. 2 and 5, has a valve seal 33 in slidable sealing engagement with inner wall 34 of piston stem 23 in the inactive position of FIG. 2. Means cooperating between seal 33 and wall 34 are provided to establish a discharge valve open position as will be developed more fully hereinafter. Such means may comprise a plurality of external grooves 35 and seal 33 terminating a short distance from lip 36 of the seal. And, inner wall 34 in the vicinity of the seal has an enlarged diameter presenting an annular shoulder 37.

Valve element 32 further has an upstream directed throttle valve 38 shown seated in FIG. 2 against its valve seat 39 formed in the piston. An elongated probe 41 depends from the discharge valve element and extends into the pump chamber.

Inlet check valve 42, to be more fully described in detail hereinafter, is seated against its valve seat 43 formed by an inner lower shoulder within the pump cylinder defining a circular edge as shown.

Figure 6:
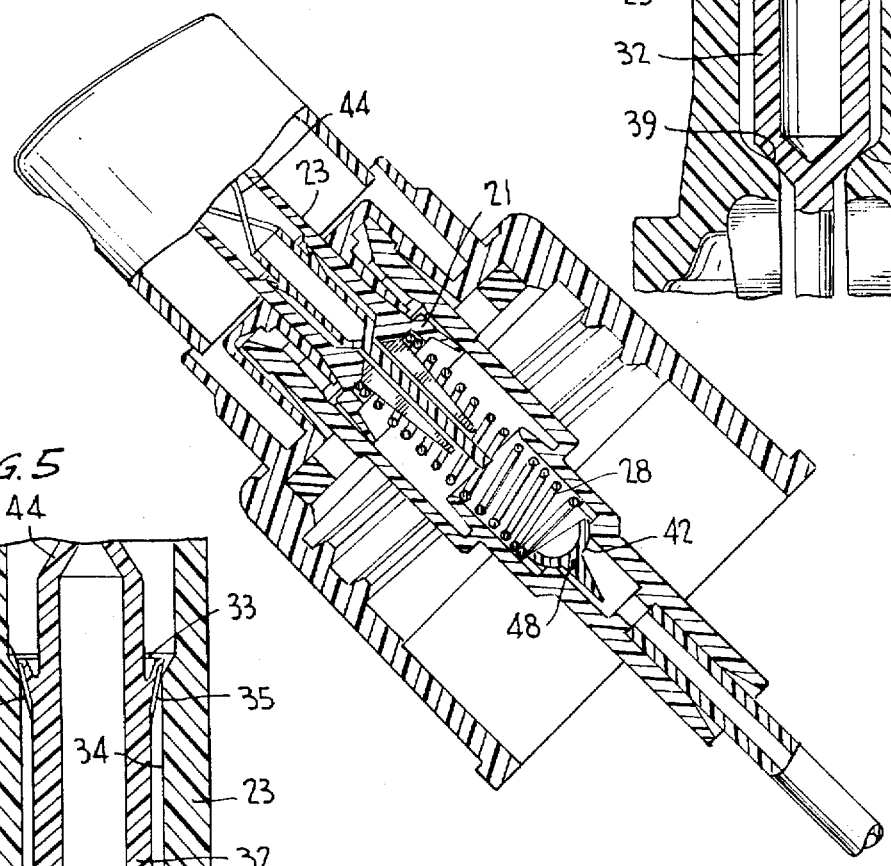
FIG. 6 is a view similar to FIG. 1 showing a tilted angle at which the pump can be effectively operated.
Figure 7:
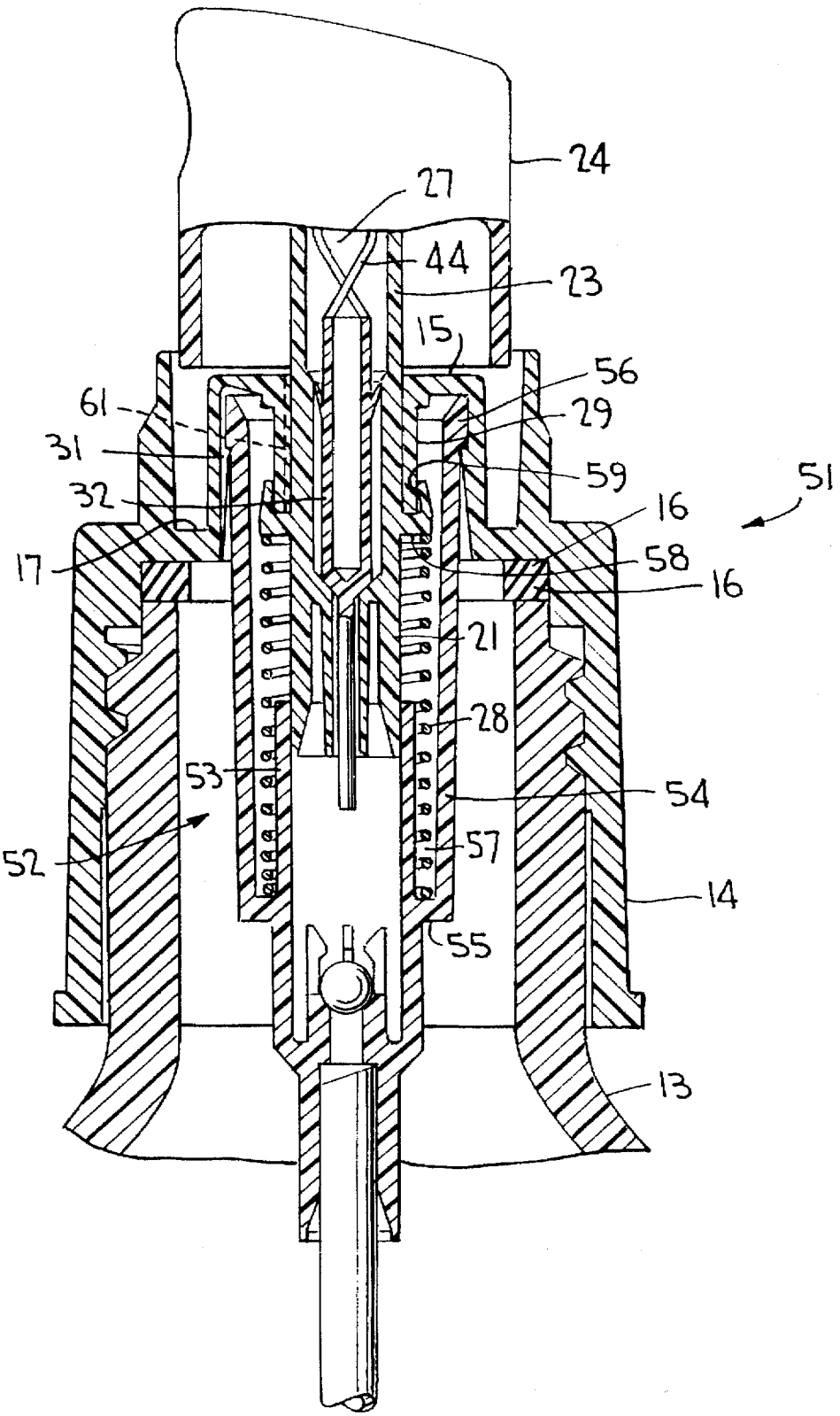
FIG. 7 is a view similar to FIG. 1 of another pump sprayer embodiment having a dry piston return spring located outside the pump chamber and an improved container vent control.

Discharge valve element 32 is spring biased into its valve closed position of FIGS. 1, 6 and 7 by a secondary spring 44 which may be of molded plastic construction formed integrally with the popper valve. The secondary spring bears at its downstream end against the underside of the plunger head, and is located within the hollow stem and the plunger head as shown.

Figure 4:
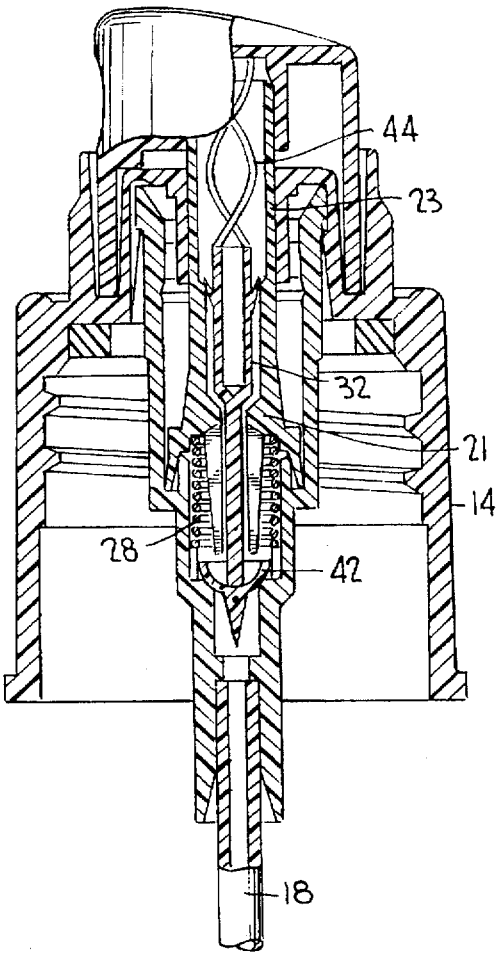
FIG. 4 is a view similar to FIG. 1 showing the piston at the end of its full downstroke at which the discharge is open for priming the pump through the discharge passage.

To prime the pump, the unwanted air must be expelled from the pump chamber as in any pre-compression pump sprayer. As air is compressible, the pump piston can be readily full stroked as shown in FIG. 4, whereupon it bottoms out within the pump cylinder. Probe 41 of the discharge valve element has a predetermined extent such that the lower free end thereof abuts against inlet check valve 42 at a full downward stroke of the piston shown in FIG. 4 creating a lost-motion effect in shifting the discharge valve element relative to the piston and its stem causing throttle valve 38 to unseat from its valve seat, and shifting seal 33 such that its grooves 35 engage shoulder 37 for fully opening the discharge, as shown in FIG. 5. In such manner, the compressed air within the pump chamber is expelled through the open discharge valve and out through the discharge orifice via the discharge passage. Positive priming is thus achieved with one or more initial strokes.

On each ensuing upstroke of the piston, the expanded pump chamber creates a negative pressure therein, drawing liquid from the container up through the dip tube and inlet port and into the pump chamber via the unseated inlet valve. When fully primed, throttle valve 38 establishes a predetermined pressure threshold which when exceeded by fluid pressure generated in the pump chamber during each piston pressure stroke immediately opens throttle valve and abruptly releases the fluid pressure at the valve open position at which grooves 35 engage shoulder 37, as shown in FIG. 5, permitting product to be sprayed under pressure through the discharge orifice in the form of a fine mist spray. The discharge valving arrangement of the invention thus presents a two-stage pressure build-up discharge valve which abruptly opens and closes depending on the relationship between the hydraulic pump chamber pressure and the predetermined pressure threshold.

During each piston suction stroke, the negative pressure created in the expanding pump chamber draws liquid product into the pump chamber from the container as in any normal pumping operation for this type pump. However, as the hydraulic pressure within the chamber falls below the predetermined pressure threshold as aforedescribed at the commencement of the piston return, the discharge remains open momentarily until the piston is shifted outwardly of the pump chamber into the FIG. 2 discharge closed position. During this interval, the negative pressure of the pump chamber communicates through the discharge passage with the discharge orifice and sucks back any residual liquid product at the orifice into the spin mechanics area within the nozzle cap to avoid or minimize the formation of dribbles and drips at the orifice. This residual product is then available for discharge during the following pressure stroke.

The chosen spring force relationship between the primary and secondary springs assists in setting the short interval during which the discharge remains open at the commencement of the piston return stroke.

A plurality of guide fingers 45, such as three or more, may be integrally molded with the piston for surrounding probe 41 to serve as a guide. Moreover, the discharge valve element may be hollow as shown to conserve material.

Figure 3:
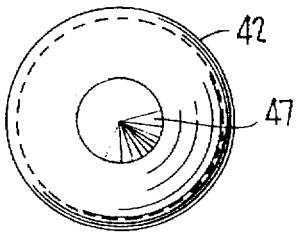
FIG. 3 is a bottom plan view, at an enlarged scale, of the inlet check valve according to the invention.

According to another feature of the present invention, inlet check valve 42 comprises a plastic molded part having a hollow, spherical portion 46 seated at its outer spherical surface against valve seat 43 in the inlet valve closed position. And, the inlet valve has an integrally molded coaxial depending leg 47 (FIG. 3), the projection extending in a direction upstream of valve seat 39. Leg 47 is conically shaped and its tip end is spaced from inlet port 19 to avoid interference in the valve closed position. The mass of leg 47 establishes a center of gravity 48 for the inlet check valve which center of gravity is located upstream of valve seat 43, as shown in FIGS. 1, 4 and 6.

A plurality of longitudinally extending ribs 49 are molded within the inner throat end of the pump cylinder surrounding spherical portion 46 of the inlet valve in slightly spaced relationship to avoid interference. The ribs extend beyond the downstream, upper edge of spherical portion 46 in the upright position of FIG. 1, and function as bearing elements for the lower end of primary piston return spring 28. The gauge of the primary spring coils is slightly greater than the thickness of ribs 47, such that the lower end of the primary spring slightly overlies the upper edge of the spherical portion of the inlet valve to provide a valve cage, thereby eliminating the need for detents or other valve cage elements.

The lower center of gravity of the inlet valve assures that spherical portion 46 of the valve will be maintained in seated engagement with valve seat 43 during operation of the sprayer in attitudes other than upright, such as at 45° or the like, as shown in FIG. 6. Inlet valve 42 therefore functions similarly as a ball check valve, fluid tightly sealed against its circular valve seat, while avoiding the drawbacks normally attendant to such a ball valve which upsets from its valve seat while the sprayer is operated at various tilt angles, permitting blow-by through a partially unseated valve during the pressure strokes. The low center of gravity of inlet valve 42 of the invention avoids blow-by through the valve which remains seated when operating the pump in attitudes tilted from upright. The valve cage provided by the lower end of the primary spring permits the inlet valve to lift off its seat without interference during each suction stroke of the piston.

In the FIG. 7 embodiment, wherein like parts of FIG. 1 are identified by like reference numerals, the precompression pump sprayer generally designated 51 has a pump body 52 of slightly different configuration.

Pump cylinder 53 has a reduced length, and a spaced cylindrical wall 54 is integrally molded at one end 55 to cylinder 52 and has its other end 56 coupled to domed portion 15 of closure 14 for mounting sprayer 51 to container 13. Wall 54 defines an annual cavity 57 with the pump cylinder which houses piston return spring 28 extending between end 55 and the underside of a flange 58 on piston 21. In such manner a "dry" return spring is provided, i.e., one that is not wetted with liquid in the pump chamber. This permits a cost reduction by using a lower cost steel spring.

Also, the container vent passage has a diametral seal by the provision of an annular seal bead 59 on flange 58 in tight sealing engagement with the outer surface of sleeve 29 in the inactive position of the pump sprayer shown in FIG. 7.

The inner diameter of sleeve 29 may be slightly enlarged relative to the outer diameter of piston stem 23 to form an annular gap defining a portion of the container vent passage which is sealed closed in the FIG. 7 position. Or, the inner surface of sleeve 29 may be provided with one or more longitudinal grooves 61 for this purpose.

From the foregoing, it can be seen that a simple and economical yet highly effective pre-compression pump sprayer is provided with fewer parts compared to prior art structures and has a positive pump priming feature for evacuating unwanted air from the pump chamber, utilizing a lost-motion effect created by the poppet valve itself without the need for ribs or grooves defining pump chamber vent passages as in the prior art. The unwanted air is released from the pump chamber directly through the discharge orifice, and a unique suck-back feature is developed to eliminate or at least minimize the formation of dribbles and drips at the discharge orifice at the commencement of each suction stroke of the piston. Moreover, the inlet check valve has its center of gravity located upstream of its valve seat to assure full engagement with the seat during operation of the pump in attitudes tilted from upright. Blow-by of product through the inlet valve during pumping is therefore positively avoided.

A two-stage pressure build-up discharge valve element facilitates abrupt opening and closing of the discharge and the discharge of an evenly distributed fine mist spray.

A dry piston return spring is available to save costs, and a diametral container vent passage sealing arrangement is provided for enhancing the reliability and effectiveness of the seal.

Obviously, many modifications and variations of the present invention are made possible in the light of the above teachings. For example, the means cooperating between the popper valve seal and the inner wall of the piston stem can be in the form of longitudinal grooves located below shoulder 37 of seal 33. It is therefore to be understood that within the scope of the appended claims the invention may be practiced otherwise than as specifically described.

What is claimed is:

1. A precompression pump sprayer, comprising, a pump body having a pump piston reciprocable in a pump cylinder to therewith define a variable volume pump chamber, a piston return spring in said pump body, said cylinder having a liquid product inlet valve, said piston having a discharge valve seat and a hollow stem defining a valve controlled fluid discharge passage therethrough, a spring biased discharge popper valve element having a seal in sliding sealing engagement with an inner wall of said stem, means cooperating between said seal and said inner far wall, establishing a discharge valve open position, said valve element having an upstream directed throttle valve establishing a predetermined pressure threshold which when exceeded by fluid pressure generated in said pump chamber upon piston reciprocation immediately opens the throttle valve and abruptly releases the fluid pressure at the valve open position.

2. The pump sprayer according to claim 1, wherein said discharge valve element has an elongated probe of predetermined length for engaging said inlet valve in a downstroke position of said piston for shifting said valve element into said valve open position for venting said pump chamber.

3. The pump sprayer according to claim 1, wherein said inner wall has an enlarged diameter present a shoulder downstream of said seal to define said cooperating means together with grooves provided on said seal.

4. The pump sprayer according to claim 1, wherein said cylinder has an inlet valve seat comprising a shoulder presenting a circular edge, said inlet valve having a spherical surface engaging said edge in an inlet valve closing position.

5. The pump sprayer according to claim 4, wherein said inlet valve has a hemispherical position and a coaxial depending leg establishing a center of gravity of said inlet valve to lie upstream of said circular edge permitting said inlet valve to remain seated during pumping at various angles of tilt.

6. The pump sprayer according to claim 4, wherein said return spring is seated in said cylinder against a plurality of upstanding ribs surrounding said inlet valve, a portion of said spring overlying said inlet valve to define a valve cage.

7. The pump sprayer according to claim 5, wherein said return spring is seated in said cylinder against a plurality of upstanding ribs surrounding said inlet valve, a portion of said spring overlying said inlet valve to define a valve cage.

8. The pump sprayer according to claim 1, wherein said pump body further has a spaced cylindrical wall connected at one end to said pump cylinder, said return spring extending between said one end outwardly of said pump chamber and flange means provided on said piston.

9. The pump sprayer according to claim 8, further comprising means coupled to said cylindrical wall for mounting the pump sprayer to a container of product to be sprayed, said mounting means having container vent passage means extending between the interior and exterior thereof, said flange means on said piston having a seal bead in engagement with an inner depending sleeve on said mounting means for sealing said vent passage means closed in an inactive position of the pump sprayer.

10. A precompression pump sprayer, comprising, a pump body having a pump piston reciprocable in a pump cylinder to therewith define a variable volume pump chamber, a piston return spring in said pump body, said cylinder having inlet valve means, said piston hang a discharge valve seat and a hollow stem defining a valve controlled fluid discharge passage, a two-stage spring biased discharge valve element in sliding sealing engagement with an inner wall of said stem and having a throttle valve, means for breaking the sealing engagement between said valve element and said inner wall of said stem for establishing a discharge valve open position, said throttle valve facing said pump chamber and establishing a predetermined pressure threshold which when exceeded upon a build-up of pressure in said chamber during piston reciprocation immediately opens the throttle valve and abruptly releases the fluid pressure at the valve open position.

11. The pump sprayer according to claim 10, wherein valve element has a probe extending into said pump chamber for shifting said element to the valve open position upon engagement with said inlet valve means for initially expelling unwanted air from the pump chamber during priming.

12. The pump sprayer according to claim 10, wherein said inlet valve means comprise a hemispherical inlet valve having a spherical surface engageable with a shoulder on said pump cylinder defining a circular edge inlet valve seat.

13. The pump sprayer according to claim 12, wherein said inlet valve has coaxial depending conical steam for establishing a center of gravity of said inlet valve upstream of said inlet valve seat permitting pumping at various tilt angles of the sprayer.

14. The pump sprayer according to claim 10, wherein said pump cylinder has a spaced outer cylindrical wall defining an annular cavity, said return spring lying within said cavity and extending to external flange means provided on said piston.

15. The pump sprayer according to claim 14, wherein means coupled to said cylindrical wall is provided for mounting the pump sprayer to a container of fluid to be sprayed, said mounting means having container vent means extending between inner and outer sides thereof, said external flange means having a seal bead engageable with a depending inner sleeve of said mounting means for said container vent means closed in an inactive position of the pump sprayer.

* * * * *